United States Patent [19]

Vanderbilt

[11] Patent Number: 4,834,332

[45] Date of Patent: May 30, 1989

[54] IRONING BOARD STORAGE APPARATUS

[76] Inventor: Mark T. Vanderbilt, 1336 SW. Thelma St., Palm City, Fla. 34990

[21] Appl. No.: 146,494

[22] Filed: Jan. 21, 1988

[51] Int. Cl.[4] ..... E04G 3/00

[52] U.S. Cl. ..... 248/291; 108/48; 248/293

[58] Field of Search ..... 108/42, 48; 248/467, 248/291, 293

[56] References Cited

U.S. PATENT DOCUMENTS

| | | | |
|---|---|---|---|
| 370,991 | 10/1887 | Taxis et al. | 108/48 |
| 667,164 | 1/1899 | Carder . | |
| 1,210,095 | 12/1916 | Noak . | |
| 1,427,343 | 8/1921 | Ballard . | |
| 1,671,881 | 5/1928 | Barrie | 108/48 |
| 1,795,636 | 3/1929 | Chandler . | |
| 1,858,765 | 4/1927 | Cramer . | |
| 1,909,093 | 5/1933 | Buffelen | 108/48 X |
| 1,940,128 | 12/1932 | Howard . | |
| 2,014,549 | 9/1934 | Behm . | |
| 3,276,815 | 10/1966 | Cardy | 108/48 X |
| 3,730,107 | 5/1971 | Bergcamp . | |
| 3,742,868 | 7/1971 | Garceau . | |
| 3,748,010 | 7/1973 | Garte | 108/48 X |
| 3,965,588 | 6/1975 | Long . | |
| 4,310,137 | 1/1982 | Frye | 248/467 |
| 4,337,709 | 7/1982 | Nicholson | 108/42 X |

*Primary Examiner*—Peter A. Aschenbrenner

[57] ABSTRACT

An ironing board storage apparatus wherein the design allows the conversion of existing conventional ironing boards, from their characteristic free standing position, to a vertically stored unit. The mounting mechanism includes a connected bracket with means for pivotally moving the ironing board from a folded vertically stored position to a fully extended work position. All weight and downward pressure is thereby transferred to the floor surface. Without requiring a mechanical release, the two piece integrated bracket permits separation of the ironing board from its vertical attachment for use in another location.

1 Claim, 2 Drawing Sheets

48" LONG
20" WIDE
4" DEEP

IRONING BOARD STORAGE APPARATUS

BACKGROUND

1. Field of Invention

This invention pertains to the field of folding ironing boards and tables and more particularly the method of storing such units on a vertical surface.

BACKGROUND

2. Discussion of Prior Art

Ironing boards have been well used and accepted in virtually every household in the United States since before the turn of the century. Many attempts have been made over the years to provide storage for ironing boards, tables and sewing machines in order to create more usable living space. With a few exceptions, ironing boards were concealed in a cabinet type enclosure or box and then mounted on or recessed into a vertical surface. For all practical purposes, these storage units were designed to give the stored items a better appearance and easy accessability, thus resulting in a more organized household.

While alleviating the task of physically lifting and removal of the ironing board or table from a storage area, the prior art has not totally solved the problem.

The majority of the prior art was designed with attached ironing boards and tables that are too complex for practical purposes. Some parts in the complicated designs could, from abuse or normal wear, cause distortion, misalignment and or jamming of the folding mechanism. Many designs demand total support from the wall unit itself. Excessive downward pressure on the surface of the ironing board or table could put undue strain on the complete storage assembly. Much of the prior art tends to design towards complicated and expensive types of storage units that require major installation techniques. None of the recent prior art has addressed the feasability of inexpensive easily installed combinations.

Finally it is the object of this present invention to add versatility and improvements to the existing manufactured ironing board and table. The unique design of the holding bracket and ease of installing the present invention, has the ability to change a conventional free standing ironing board or table into a practical conveniently stored item.

Other objects and advantages of the present invention will be evident from the following detailed description. When used in conjunction with the accompanying drawings, the present invention will be illustrated in detail.

DRAWING REFERENCE NUMERALS

Figure 2:
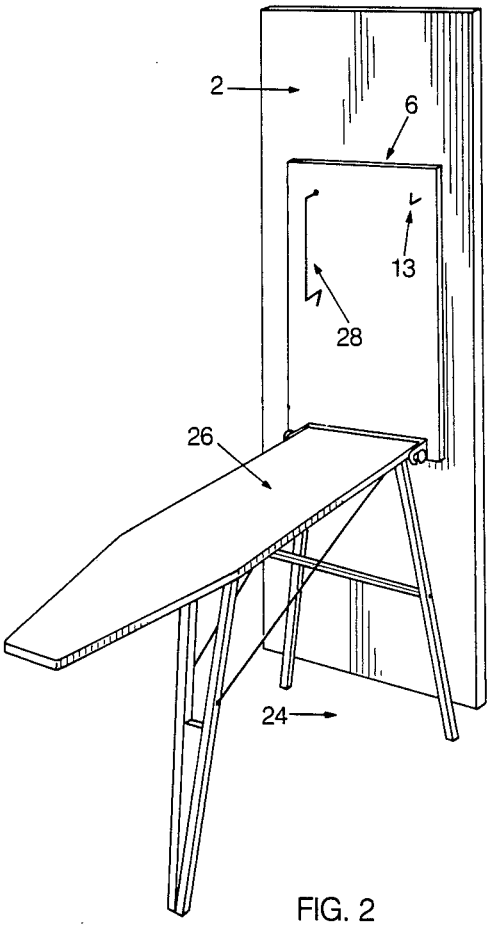
FIG. 2 illustrates the present invention with the components in work or use position.
Figure 4:
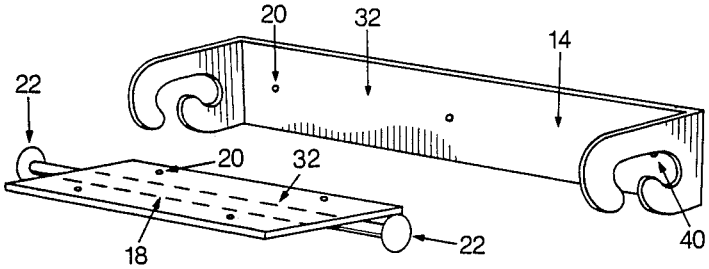
FIG. 4 illustrates the two piece mounting bracket of the present invention showing its unique design.
Figure 6:
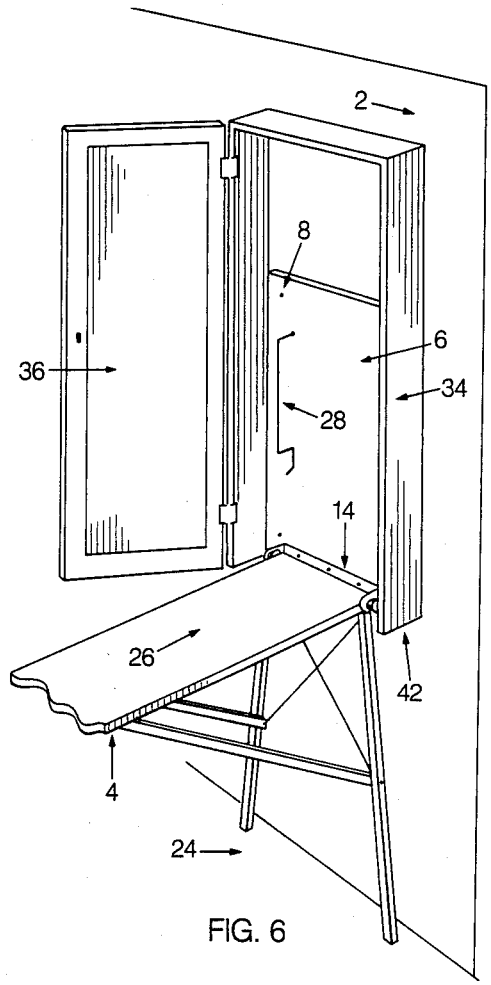
FIG. 6 illustrates the present invention in the work or use position installed in an open cabinet.

2 vertical surface such as a wall or door
4 ironing board
6 backboard
8 holes in backboard
10 Velcro ® type hook and loop pads
12 fastening arrangement
13 hook or loop part of 12
14 backboard bracket part
18 ironing board bracket part
20 holes in bracket
22 tapered ends
24 floor surface
26 top surface of ironing board
28 strap in release position FIG. 2 and FIG. 6
30 horizontal position of backboard
32 flat surface of brackets
34 cabinet or box
36 cabinet door
38 wide end of board
40 pivot groove or opening
42 bottom of cabinet

DETAILED DESCRIPTION OF THE INVENTION

Figure 1:
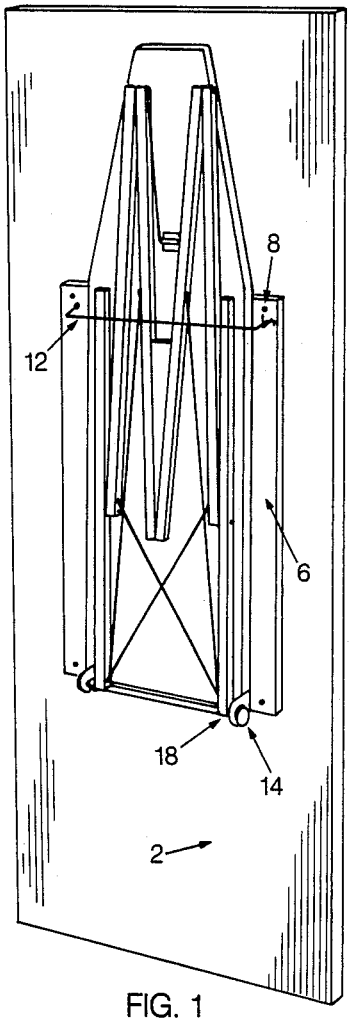
FIG. 1 illustrates the ironing board in the vertical stored position utilizing the bracket and backboard of the present invention.
Figure 3:
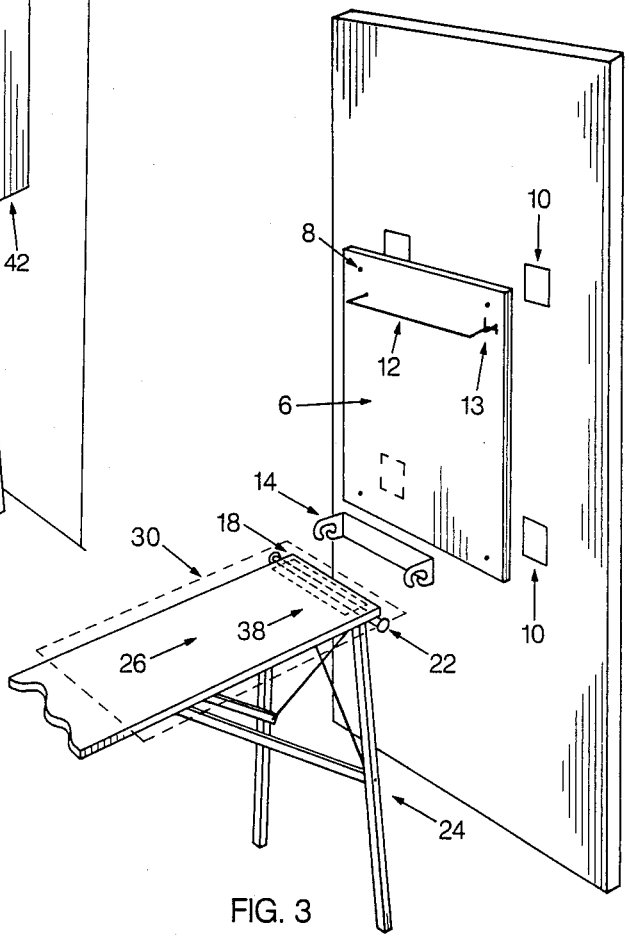
FIG. 3 illustrates the present invention in the work or use position with an exploded perspective view.

Referring to FIG. 1, the ironing board storage apparatus is depicted in the stored position as mounted on a vertical surface 2. The vertical surface 2, as illustrated in the drawings, is construed to be a wall or the inside or back of a dwelling door. The ironing board 4 is held in the folded upright position by means of a fastening arrangement 12. This fastening arrangement 12 can be devised of materials such as wire, metal band, rubberized fabric or one of the plastics or synthetics that are available. One end of the fastening arrangement 12 is permanently secured to the backboard 6. The other end is equipped with a hook or loop of simple means so as to permit easy release when raising or lowering the ironing board 4. Referring to FIG. 2, the ironing board 4 is illustrated in the work or use position with the fastening arrangement 12 in the release position 28. This permits the legs of the ironing board 4 to unfold and descend to the floor surface 24. FIG. 3 illustrates the present invention in its work or use position. An exploded view is shown permitting all parts to be isolated and easily referred to. The present invention includes a piece of suitable rigid material approximately ½ inch thick and 18 inches wide by 30 inches long covered with a plastic laminate or another durable finish. The Backboard 6 is secured to a vertical surface 2 by using a sufficient number of adhesive backed Velcro ® type pads 10. The size of these pads provide adequate holding strength to support the complete ironing board storage apparatus in all of the necessary positions. The backboard 6 incorporates an ironing board fastening arrangement 12, as previously outlined, that is of adequate strength and design to maintain the ironing board 4 in a vertical stored position against the backboard 6. The backboard 6 contains a number of predrilled holes 8 permitting alternate methods of securing to a vertical surface 2 with screws or other types of fasteners. The mounting holes 8 are spaced 16 inches apart across the top and bottom of the backboard 6 which conforms to standard wall stud framing practices. The backboard bracket part 14 is secured to the bottom edge of the backboard 6 by means of adhesive, screws or other types of fasteners. The ironing board bracket part 18 and the backboard bracket part 14 are designed to interlock with one another and thereby preventing unintentional separation.

Figure 5:
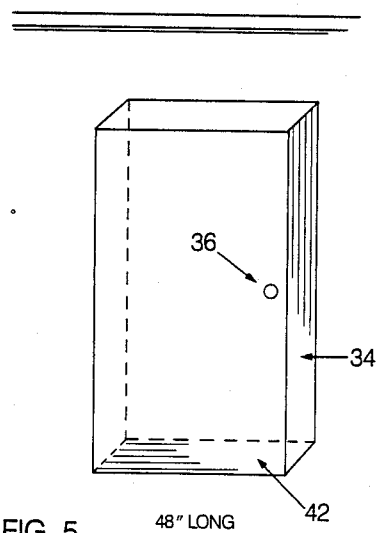
FIG. 5 illustrates the present invention in the stored position enclosed in a cabinet.

The present invention can be enclosed in a cabinet or box 34, as referred to in FIG. 5 and FIG. 6, with various styles or doors 36 affixed. The cabinet design of the present invention utilizes all of the previously mentioned components. The cabinet or box 34 differs from prior art with the omission of the bottom 42. This is required to permit the ironing board 4 to pivot, unobstructed, from the stored position to the work or use position. Methods of securing the cabinet or box 34 to a vertical surface 2 are the same methods applied for the installation of the backboard 6.

OPERATION OF THE INVENTION

Conventional free standing ironing boards are probably found in virtually all households. Until the present invention, these ironing boards had to be folded and stored in a closet, stood behind a door or left standing in an open position usually in the path of normal movement within the household. The left standing ironing board almost always becomes a tempting catch all surface. Therefore, when the ironing board must be used, it becomes necessary to remove items previously placed on the ironing board top surface. The present invention changes this undesireable practice by offering a way to convert the free standing ironing board into a convenient stored unit. Cost and ease of installation were primary requirements affecting the design of the present invention. By following instructions included with the packaged present invention, the only tools required for most installations are a ruler, a pencil and possibly a screw driver. After removal from the shipping carton, the installer is instructed to unfold the legs of the ironing board 4 and position the ironing board 4 in an upright or work mode. At this stage, the backboard 6 is in the horizontal position 30 lying on the top surface of the ironing board 26. The complete assembly is then moved to the selected place of installation with the wide or bracket end 38 of the ironing board 4 against the vertical surface 2. The backboard 6 is then raised to a vertical position 33 touching the vertical surface 2. The backboard 6 will pivot and remain in the backboard bracket 14 groove 40 throughout this step. After determining the exact location of the backboard 6, all four corners are marked on the vertical surface 2. The backboard 6 is then returned to the horizontal position 30. The hook part of a sufficient number and size of Velcro ® type pads 10 have been attached to the rear of the backboard 6 prior to packaging. The loop part of the self adhering Velcro ® type pads 10 are then applied to the vertical surface 2 using the previously marked outline of the backboard 6 as reference points. The backboard is raised once more against the vertical surface 2. To assure connection of the hooks and loops of the Velcro ® type pads 10, hand pressure is applied to the four corners of the backboard 6. The ironing board can no be raised to the storage position as it pivots in the backboard bracket part 14. The ironing board 4 is now secured in a vertical position by the fastening arrangement 12. To put the ironing board 4 in a work or use position, the fastening arrangement 12 is released, thus permitting the ironing board 4 to descend towards the floor surface 24. At the approximate midway point of lowering, the legs of the ironing board 4 are unfolded. When the legs make contact with the floor surface, the ironing board 4 will be in the work or use position. The design of the two piece bracket 14 and 18, of the present invention, allows all of the weight of the ironing board 4 and any thereafter downward exerted pressure on the top surface 26 to be transferred through the legs to the floor surface 24. The design of the two piece bracket 14 and 18, also permits the ironing board 4 to become unattached from the backboard 6 if desired. This is accomplished by guiding the ironing board bracket part 18 through the groove 40 and out of the backboard bracket part 14 while the ironing board 4 is in the semi or fully folded position. The ironing board 4 can now be used in a free standing position or carried to another location. The procedure described above can be reversed in order to return the ironing board 4 to the stored position. The bracket design eliminates practically all wear and mechanical malfunctions due to the lack of permanently connected moving parts.

The ironing board storage apparatus functions exactly as outlined above when the unit is installed in a cabinet or box 34 with the affixed door 36 in the open position.

Thus the reader will see that the present invention provides an inexpensive, reliable and practical combination of components for converting a folding leg ironing board or table into a unit that rivals the complicated mechanisms of previously designed stored ironing boards and tables. The simple design of the present invention, with practically no moving parts, assures the user of little or no maintenance. The relatively easy installation procedure, ease of operation and low cost enhances its potential popularity. If removal of the present invention from the vertical surface 2 is desired to install at another location, the previously outlined installation methods leave little or no damage to the vertical surface 2.

While my above description contains many specificities, these should not be construed as limitations on the scope of the invention, but rather as an exemplification of one preferred embodiment thereof. Many other variations are possible. Accordingly, the scope of the invention should be determined not by the embodiment illustrated, but by the appended claims and their legal equivalents.

I claim:

1. An ironing board storage apparatus, comprising:

a two piece bracket with its first member having a thin rectangular shaped flat surface with means of attaching said flat surface in a horizontal position to a vertical surface, two identical ends therefore having a right angle to said flat horizontal surface with openings to permit easy connection or separation of brackets second member to or from said first member, and said second member having a thin flat rectangular surface with means of attachment to the under side of a conventional free standing ironing board, and comprising rod shaped tapered ends which when encouraged to enter the said openings of the said first member will guide and center said second member and thereby forming an axis or pivot and thus performing the function of a separable type of hinge, and said opening of said first member to have a width slightly larger than said rod shaped ends so as not to create undue friction at the said axis or pivot, thus said opening to have its initial starting point with a vertical configuration and then after a rise of a determined length the opening continues at a right angle and then abruptly turns another right angle which continues a determined length parallel to the initial said vertical configuration thus forming a point of pivot or axis for said second member to rotate within, and thereby said two piece bracket working as a connected unit does permit the raising or lowering of said ironing board from a free standing or stored position, and thus when the said first member is separated from the said second member, without a mechanical release required, the said ironing board can be transported to another location and used in a self supporting free standing mode.

* * * * *